US006318461B1

(12) United States Patent
Carisella

(10) Patent No.: US 6,318,461 B1
(45) Date of Patent: Nov. 20, 2001

(54) HIGH EXPANSION ELASTOMERIC PLUG

(76) Inventor: James V. Carisella, P.O. Box 10498, New Orleans, LA (US) 70181-0498

( * ) Notice: Subject to any disclaimer, the term of this patent is extended or adjusted under 35 U.S.C. 154(b) by 0 days.

(21) Appl. No.: 09/309,699

(22) Filed: May 11, 1999

(51) Int. Cl.[7] ..... E21B 23/01; E21B 23/06; E21B 33/12; E21B 33/129

(52) U.S. Cl. ..... 166/196; 166/135; 166/202; 166/387

(58) Field of Search ..... 166/118, 134, 166/135, 196, 202, 387

(56) References Cited

U.S. PATENT DOCUMENTS 3,706,342 * 12/1972 Woolley ..... 277/340
3,872,925 * 3/1975 Owen ..... 166/286
4,545,433 * 10/1985 Wambaugh ..... 166/105
4,554,973 * 11/1985 Shonrock ..... 166/192
5,010,958 * 4/1991 Meek ..... 166/382
5,579,839 * 12/1996 Culpepper ..... 166/118
5,678,635 * 10/1997 Dunlap et al. ..... 166/387

* cited by examiner

*Primary Examiner*—David Bagnell
*Assistant Examiner*—Jennifer M. Hawkins
(74) *Attorney, Agent, or Firm*—Beirner, Maynard & Parsons, LLP

(57) ABSTRACT

A subterranean well tool is run through a well bore tubular and includes a well plug having an expandable elastomer member. An articulating anti-extrusion support system is provided for the well plug to resist extrusion of the elastomer. The system includes upper and lower platforms which are shiftable outwardly by a control mandrel. The platforms support extrusion resistors in the form of a series of crushable plates over which companion flexible cups are disposed and provide blade elements which may be flexibly positioned for inter-alignment around wing portions of the crushable plates for resistance of elastomeric extrusion. An elastomer member may include a series of spirable elastomeric sealing rings which, upon application of compressive load through the mandrel, expand in a helixical configuration through truncation initiation.

15 Claims, 13 Drawing Sheets

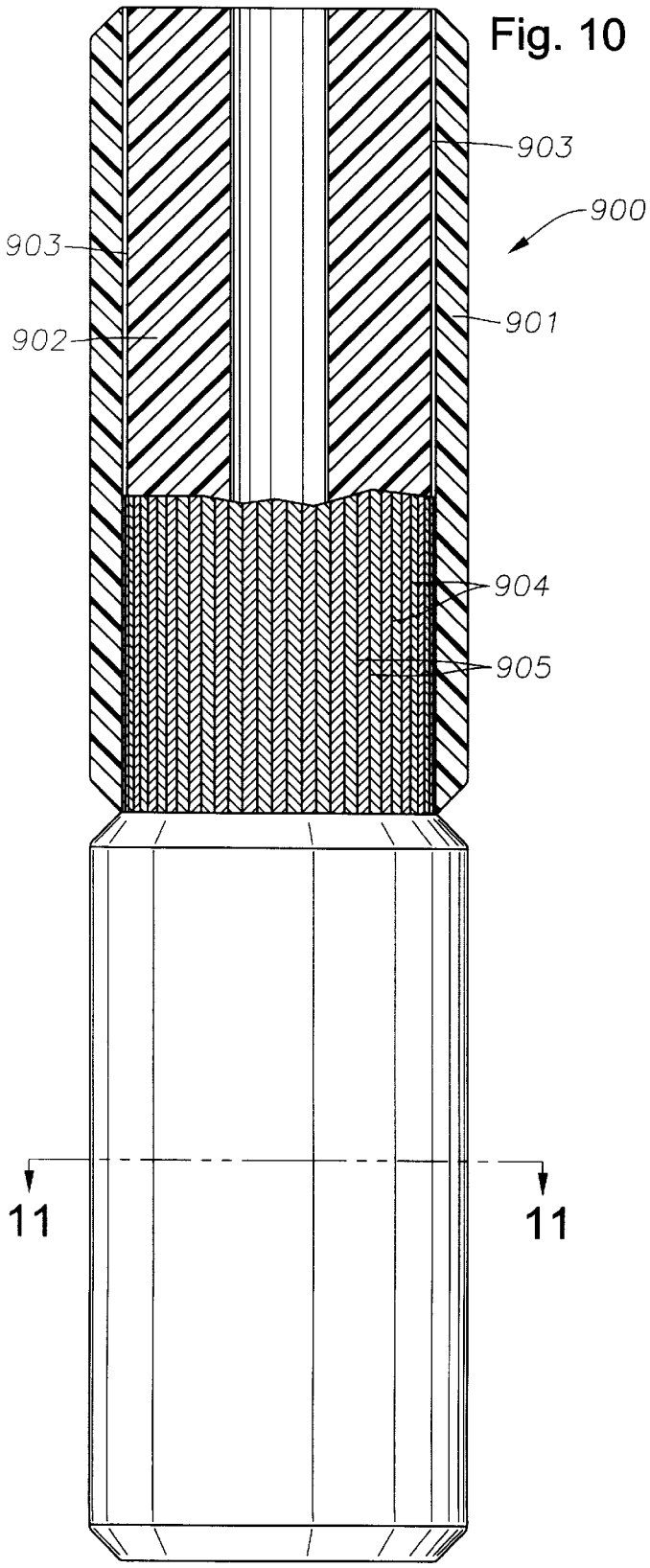
Fig. 10
Fig. 11
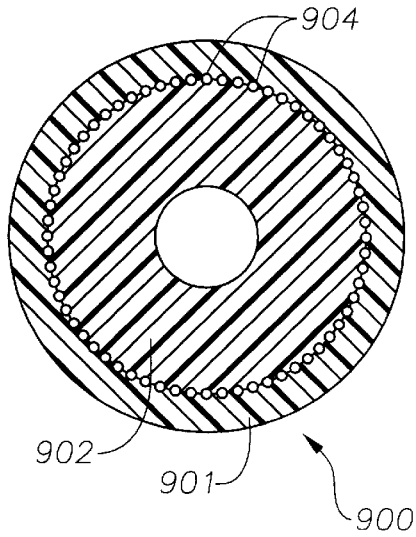

HIGH EXPANSION ELASTOMERIC PLUG

BACKGROUND OF THE INVENTION (1). Field of the Invention

The invention is directed to an articulating anti-extrusion support system for use with a well tool including a well plug having an expandable elastomer member.

(2). Brief Description of the Prior Art

During the drilling, completion or workover of a subterranean well, it is frequently necessary to isolate one or more zones or sections of the well for various purposes. A permanent or retrievable well plug, such as a packer, bridge plug, tubing hanger assembly, or the like, will include an elastomer member for sealing across an interior area in casing or other well bore tubular previously set within the well. The elastomer member of such devices is expandable from a retracted position during run-in through the casing or open hole on a conduit member, such as tubing wire line or electric line, and are activated to seal within the well bore or casing through expansion.

The elastomeric member of the well plug may be a series of rubber-like solid seal elements which are squeezed or compressed into sealing engagement with the well casing by a compressive force generated or transmitted through the well tool.

Some such well plugs require up to 16,000 pounds of force directed through the device to impart a compressive stress in the elastomer which causes it to form the necessary hydraulic seal in the well. During the application of such high compressive forces, such elastomers do not remain static, but ooze and squeeze or otherwise result in analastic behavior, often referred to as "creep" and/or stress relaxation. After the compressive force has been applied for considerable time through such elastomer, stress relaxation through the elastomer may occur. Accordingly, well plugs which can maintain high compressive loads during deformation during the setting procedure are highly desirable. The elastomer sections, in turn, require means for resisting compressive load extrusion during the setting procedure to maximize and sustain sealing integrity. Typical of the prior art is U.S. Pat. No. 3,872,925, which teaches an expandable anchoring mechanism which includes expandable fingers for anchoring the device into the casing. A similarly designed anchoring mechanism incorporating a packer element is shown in U.S. Pat. No. 3,706,342. Likewise, U.S. Pat. No. 4,554,973 teaches the use of an elastomer support system which includes a crushable element which expands during setting to define a series of radially extending petals which overlap for support of the elastomer, but no platform or other mechanism is provided for supporting the crushable elements. A similar configuration without a support platform is disclosed in U.S. Pat. No. 5,010,958.

The present invention is directed to the problems associated with such prior art mechanisms.

SUMMARY OF THE INVENTION

The present invention is directed to the combination of a subterranean well tool which is manipulatable between a run-in condition and a set position through a well bore tubular. The tool includes a well plug component, such as a packer, bridge plug, tubing or other hanger, or similar device known to those skilled in the art and having an expandable elastomer member which seals across an interior section in the well bore.

An articulating anti-extrusion support system is provided for the well plug member and contains upper and lower articulating anti-extrusion platforms, with each of the platforms including a control mandrel having sections for transmitting a compressive load through the combination and to the elastomer. A plurality of vertically aligned cylindrical members of equal outer diameter defined during the run-in condition are provided, with each of the housing members having a bore also defined therethrough for receipt of a control mandrel portion or section.

In the preferred embodiment, a series of elongated normally retracted but outwardly pivotal supporting finger elements are provided in retracted position on one of the housing members. The finger elements are movable between retracted and extended positions and are radially disposed around the exterior of such housing members. One of the ends of the finger elements is joined to the respective housing members to permit pivoting movements of the supporting fingers between the retracted and extended positions. Anchoring means are provided to secure the system to the casing for resistance of movement through of one of the platforms and to effect relative movements between the housing members for the setting of the elastomer seal.

A series of normally collapsed platform struts are radially disposed around and are outwardly extendable with respect to the other of the housings. All of the platforms struts define one outer diameter around the housing members when the tool is in the run-in position. Each of the struts have inboard and outboard ends, with the inboard end being pivotally secured to one of the cylindrical housings to selectively permit the platform struts to expand radially outwardly. Each of the platform struts is joined at the outboard end in hinged relationship to an end of a companion supporting finger element. Each of the platform struts have a face portion which is in radial alignment toward the elastomer.

The housing members, the fingers and the struts are juxtapositioned relative to one another when the combination is in the run-in position such that the platform struts are in collapsed condition and the fingers are in retracted position resulting in the outer diameter of the fingers and the struts being no greater than the outer diameter of each of the housing members. The housing members are manipulated toward one another during activation to articulate the fingers and the struts into the set position.

Each of the articulating anti-extrusion platforms contacts and supports a series of elastomer extrusion resistors which are positioned at each of the ends of an elastomer member. Each resistor includes a plate which is positioned between its receiving platform and one end of the extruding elastomer. The plate is crushable upon manipulation of the mandrel during operation, a mandrel section extending through the plate by means of upper and lower centrally defined bores. The plate member includes a series of first and second selectively radially outwardly flexible wing elements which extend around the upper and lower bores of the plate. Each of the wing elements are severed into companion wing portions. The wing elements are secured one to another such that during crushing, the wings flex relative to one another and expand outwardly, but do not separate.

A flexible cup member is placed over each end of the exterior of the plates with a cup member having a passageway aligned with the bores of the respective plate for receipt of a mandrel section therethrough. The flexible cup member provides a series of radially expandable blade members, similar in configuration as the wing elements, for overlapping inter alignment between a plurality of the wing elements when the well tool is moved to the set position.

The face portion of each of the platforms struts will contact and support at least one of the wing and blade elements during the crushing of the plate and expansion of the elastomer member by the compressive load transmitted by the well tool with the wing and blade elements also substantially intermeshing with the elastomer member at the end thereof to resist extrusion during setting.

The anti-extrusion support system is designed to transmit maximum compressive loads through the tool and preferably impart high compressive stresses in the elastomeric member while also abating extrusion, creep and stress relaxation of the elastomer member.

The elastomer member incorporated within the present invention may be one of a number of well known configurations or, alternatively, is preferably comprised of a series of spirable elastomeric sealing rings which are stacked around the mandrel and which are compressible and outwardly expandable into helixical configuration upon application of high compressive loads transmitted by the mandrel through the support system.

Truncation initiation means are provided on each of the sealing rings, preferably in the form of a radially extending notch provided around the outer diameter of the respective sealing means such that the compressive load upon the elastomer is transposed into radial helixical load to abate destruction of the elastomer as it is being expanded and crushed. Flexible thrust transmitting means, such as metallic disks, are rotatably secured around the mandrel and disposed between each of the sealing rings to transpose compressive load twisting forces generated through the mandrel into torque to activate the truncation initiation means and spiral the disks into the set position.

The invention also includes energy storage means which are chargeable by the compressive stresses applied to the seal assembly during movement of the seal assembly to the set position which are thereafter dischargeable to transmit the stored compressive stress into the seal assembly for retaining integrity of the assembly in the initial set position, thereby abating unfavorable phenomena such as analastic creep and stress relaxation as well as permanent setting of the seal assembly.

In a preferred embodiment, the invention provides platform members which are manipulated in sequence during the setting operation with one of the platforms including anchoring means for anchoring the apparatus to the inner wall of the casing.

A preferred compressible seal assembly for incorporation into the present invention, comprises an outer elastomeric cylindrical shell having a first Durometer hardness and an inner elastomeric core having a second Durometer hardness less than the hardness of the shell. A radially flexible sock member is disposed interiorly of the shell and around the core.

DESCRIPTION OF THE DRAWINGS

FIGS. 1-G and 1-H together constitute a longitudinal enlarged view of the stored energy system in initial or deactivated position.

FIG. 2-B is a view similar to that of FIG. 2-A, illustrating the lower components of the present invention.

FIG. 10 is a partial exterior, partial interior view of the preferred seating system of the present invention.

FIG. 11 is a cross-sectional view taken along line 11—11 of FIG. 10.

FIG. 12 is a schematic illustration of the component parts of the release mechanism shown during release of the plug in the well.

DESCRIPTION OF THE PREFERRED EMBODIMENTS

Figure 1A:
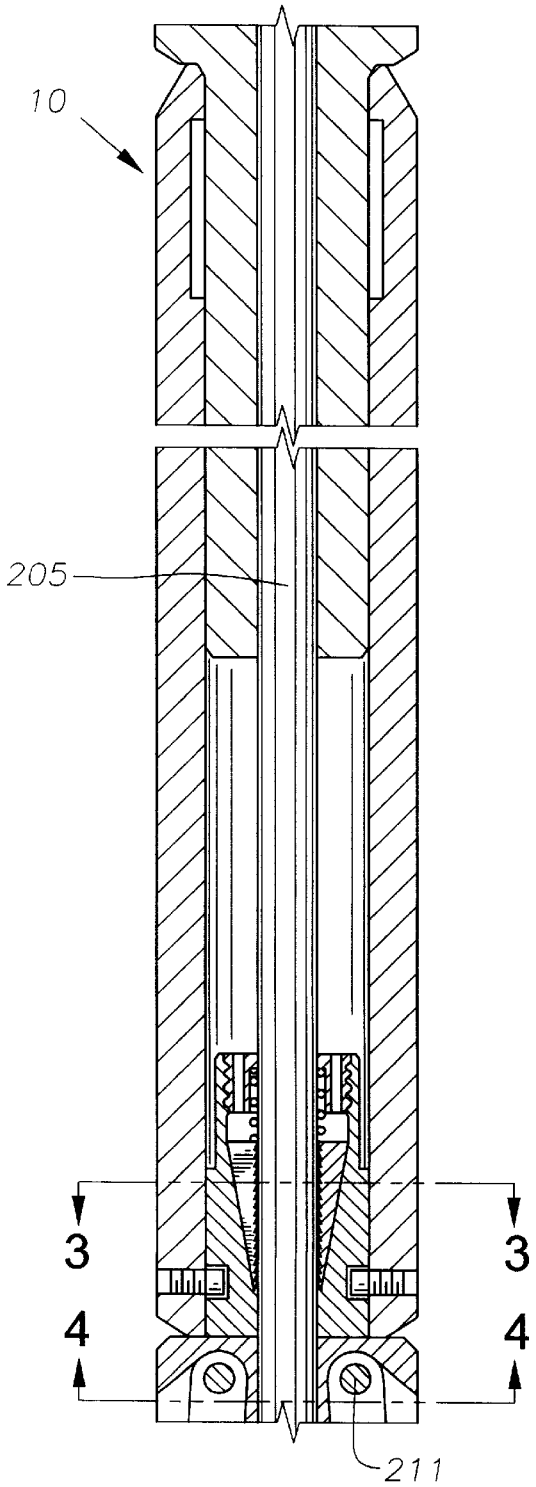
FIGS. 1-A through 1-F together constitute a longitudinally extending partial cross-sectional view of the device of the present invention in run-in, or retracted, position.
Figure 1B:
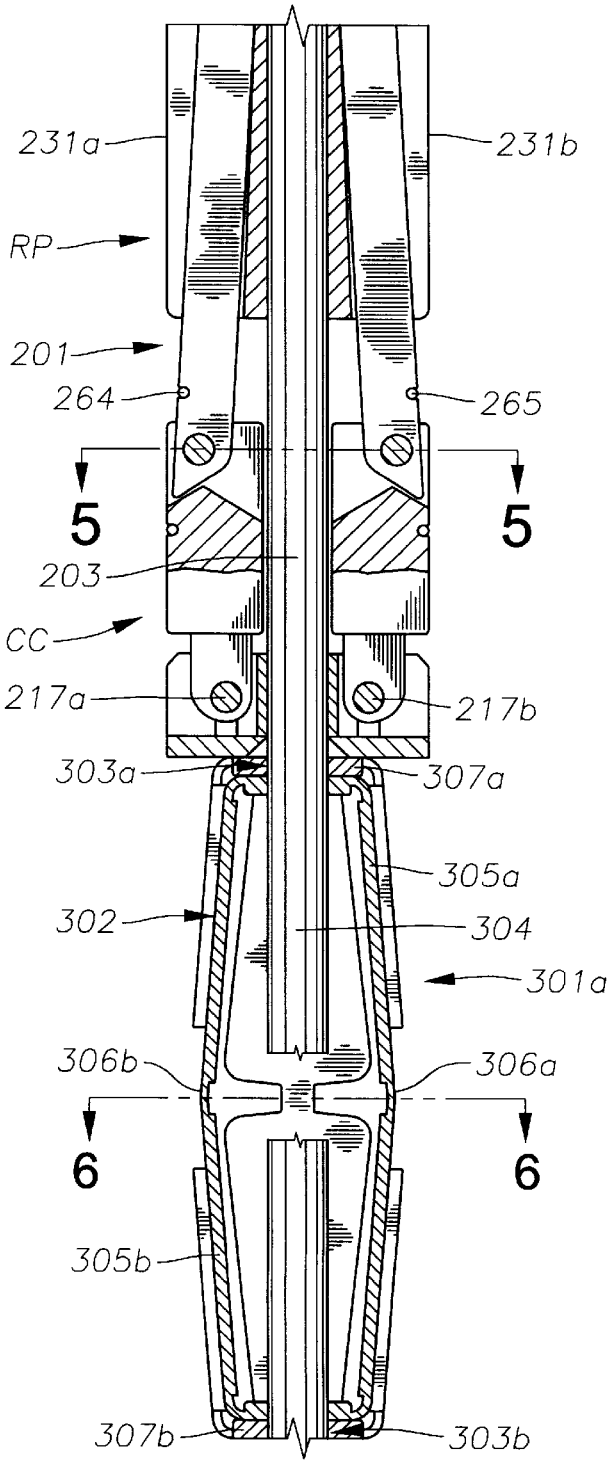
Figure 1C:
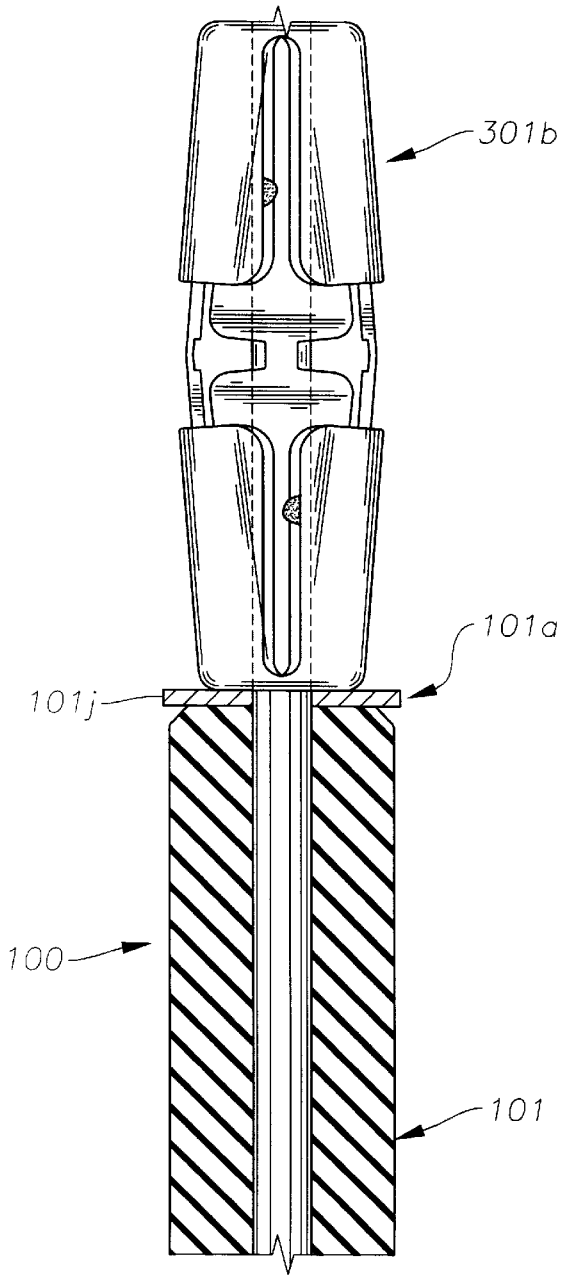

Now, with first reference to FIGS. 1-A through 1-F, a well tool 10 generally includes a well plug 100 and an articulating anti-extrusion support system 200, including upper and lower platform members 201 and 202, respectively.

A control mandrel 205 extends to a setting component (not shown) which is manipulatable to transmit required stroking motion and compressive load through the well tool 10, during activation. Control mandrel sections 203 and 204 extend through the platforms 201 and 202, upper extrusion resistors 301*a*, 301*b* and lower extrusion resistors, 302*a* and 302*b*.

The expandable elastomer member 101 has first and second ends, 101*a* and 101*b*, respectively, with the member 101 consisting of a series of sealing disk elements 101*c*, 101*d*, and 101*e*, as shown in FIG. 2-B, with bores 101*c*-1, 101*d*-1 and 101*e*-1, respectively, defined through the central portion thereof for receipt of the control mandrel 205 therethrough.

The upper and lower platforms 201 and 202 will now be discussed. As shown in FIGS. 1-B and 1-F, the upper and lower platform structures 201 and 202 are shown in retracted position RP with the struts in collapsed condition CC. Now, with particular reference to FIGS. 1-B and 2-A, the upper platform 201 includes a first cylindrical housing member 206 extending to a well tool housing member 701 which may be a cylindrical housing portion of a setting tool, or may be a profile housing for a retrieving tool, described below.

Figure 1D:
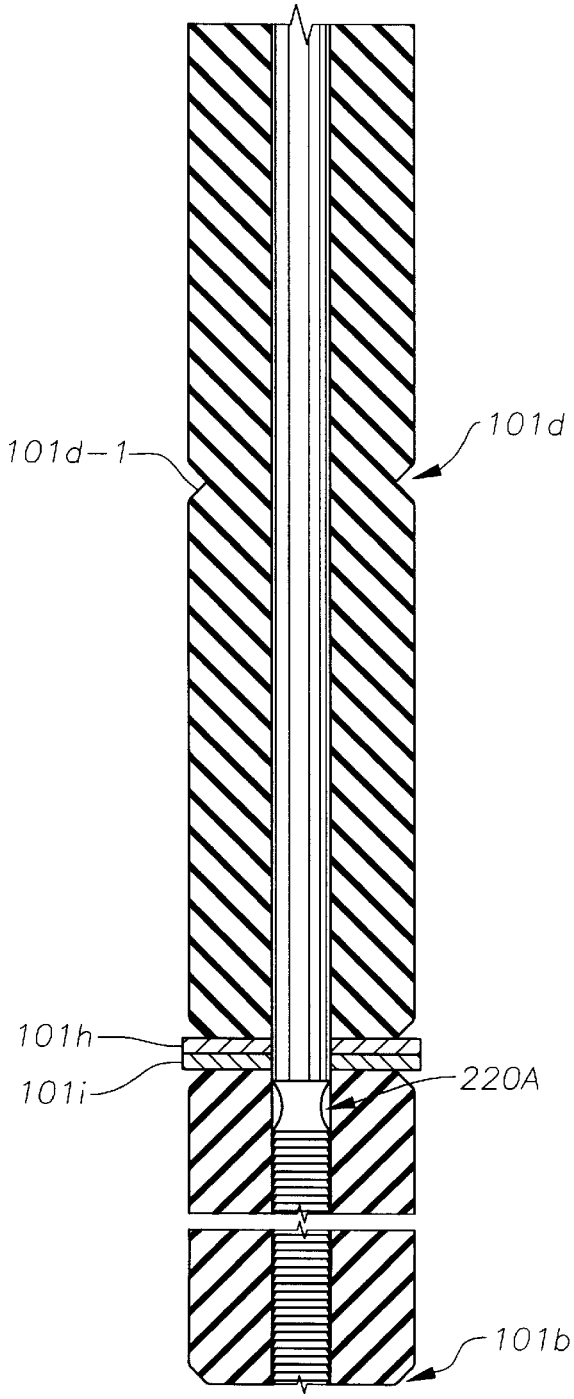
Figure 1E:
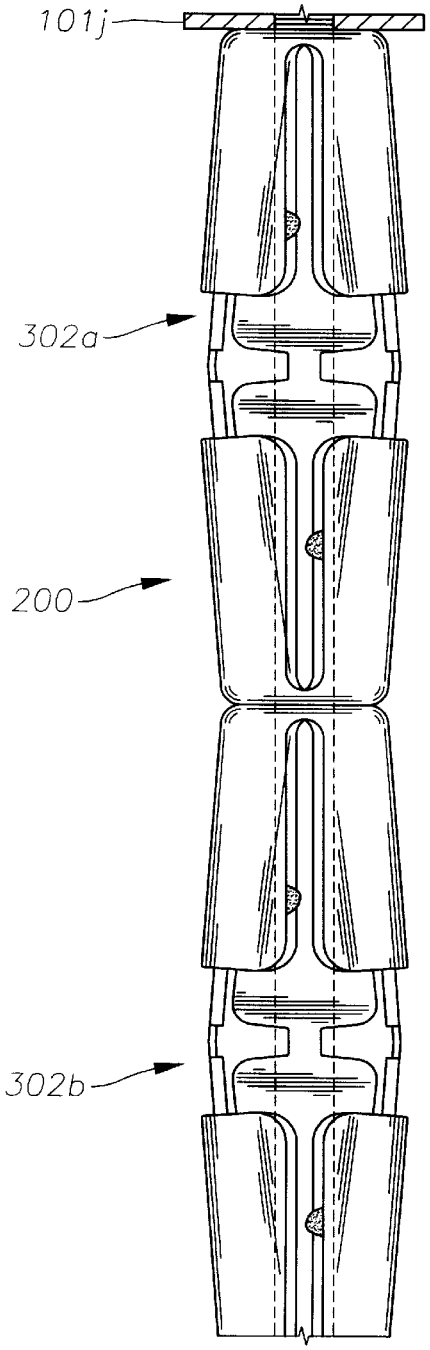
Figure 1F:
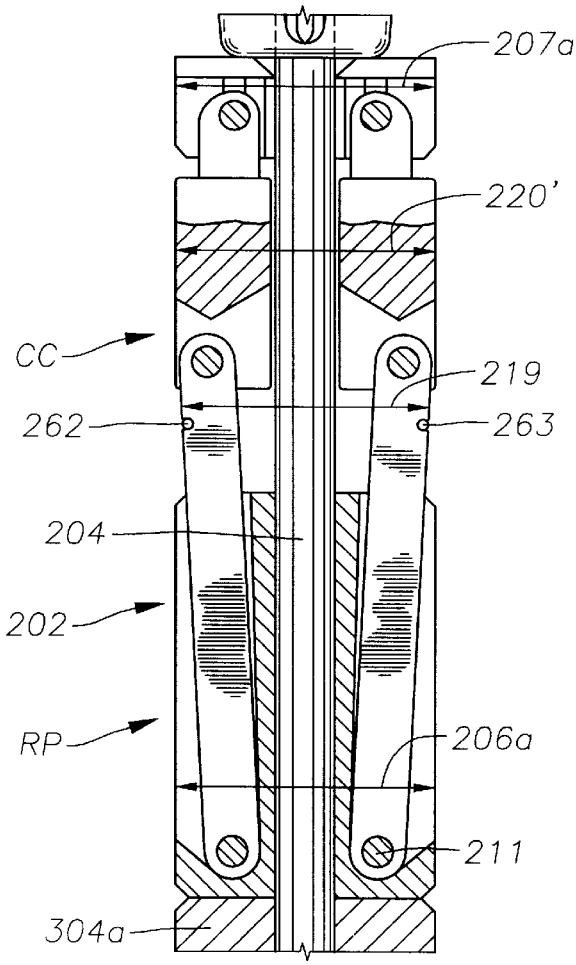
Figure 1G:
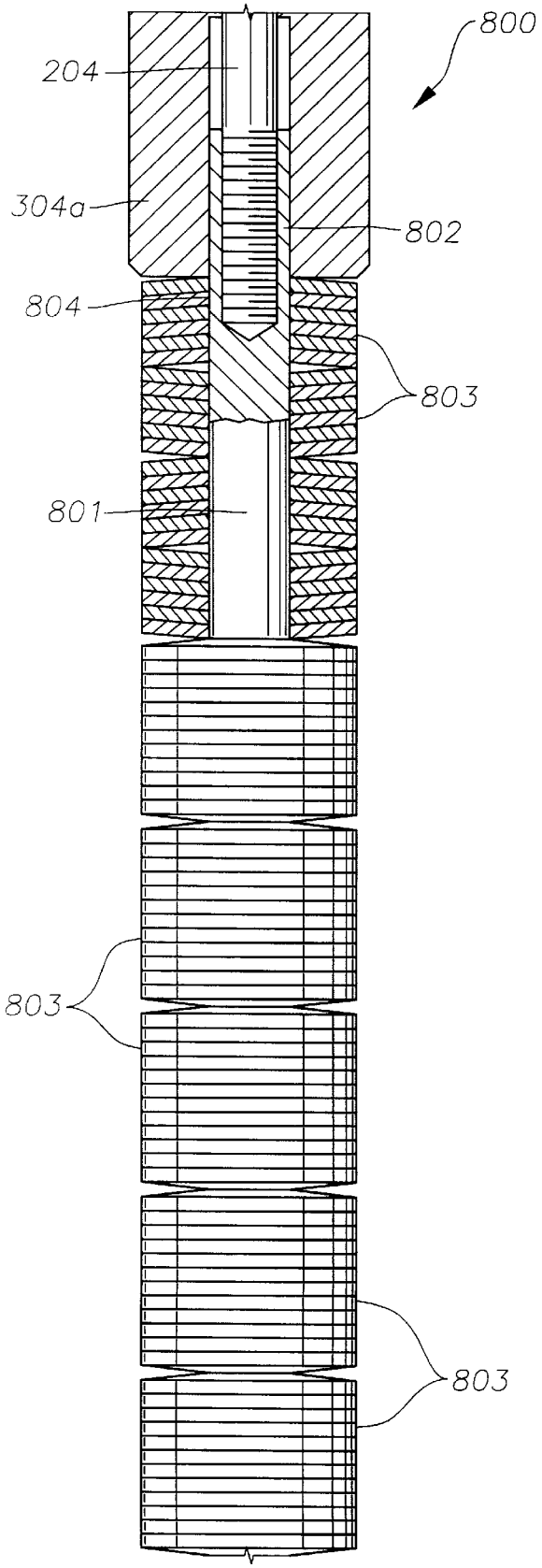
Figure 1H:
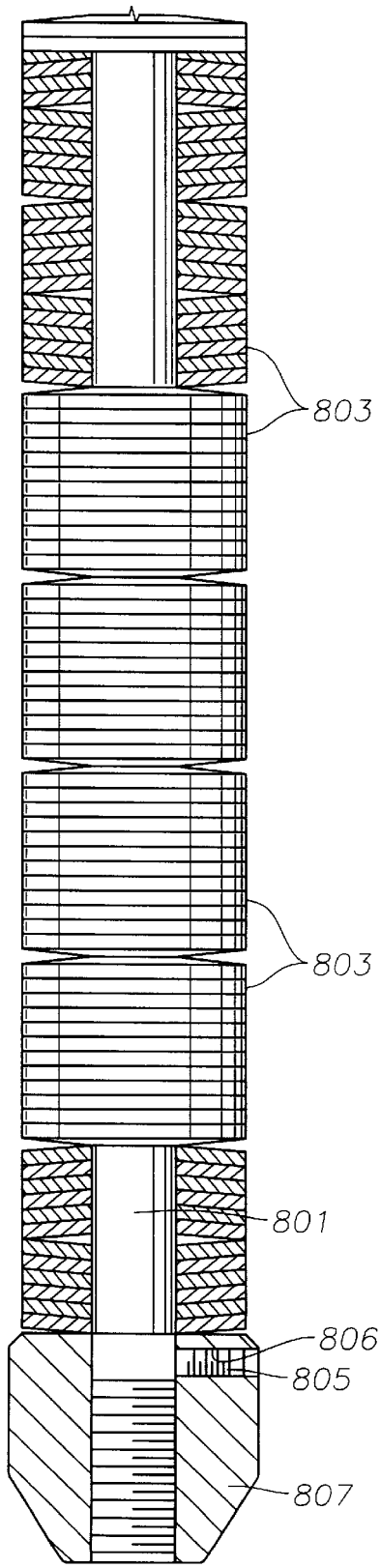
Figure 2A:
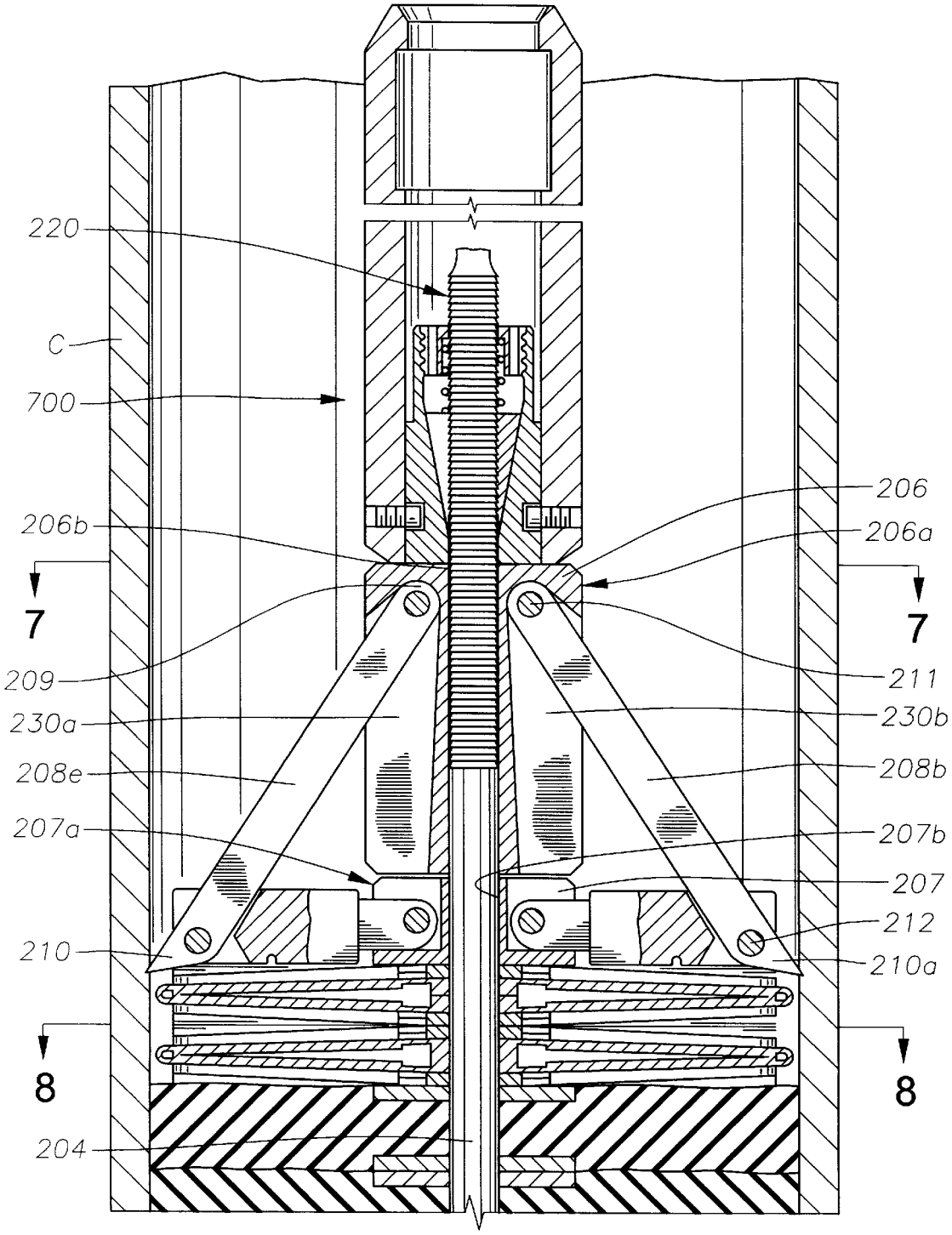
FIGS. 2-A is a cross-sectional enlarged view of the release mechanism and the upper platform extrusion resistors and sealing rings of the present invention in the set and expanded position.

As illustrated in FIG. 2-A, the well tool 10 is disposed within the well bore casing C with the housing member 206 including a bore 206*b* transposed therethrough for receipt of the control mandrel section 204. The upper housing member 206 has an outer diameter 206*a* with horizontal recepticals radially disposed there around and depicted in FIG. 2A by recepticals 230*a* and 230*b* defined between respective side wall portions 231*a* and 231*b* (FIG. 1-B). Within each respective side wall portion 231*a*, 231*b*, etc., around the first cylindrical housing member 206, are a series of finger elements 208*a*, 208*b*, 208*c*, 208*d*, 208*e* and 208*f* (FIG. 7) which are secured at the respective first ends 209 thereof by means of a pin 211 secured upon the side wall portions 231*a*, 231*b*. A release wire 265 is secured around the upper fingers 208*a*/208*f* within a receiving bore 264. A similar wire 263 is placed around the lower finger of the lower platform and within a groove or bore 262. It will be appreciated that the tinsel strength of the wire 261 is less than that of the wire 263, such that as the setting forces, or pull, is delivered to the tool to set the plug, the tinsel load of the wire 261 will be exceeded and the wire will break prior to the tinsel load of the lower wire 263 being exceeded, thus permitting the upper platform to expand and the anchoring tips 210 and 210*a* to become embedded in the wall of the casing C to anchor the mechanism in place. The upper and lower platforms and the crushable means act in sequence during the setting operation of the plug assembly.

Figure 7:
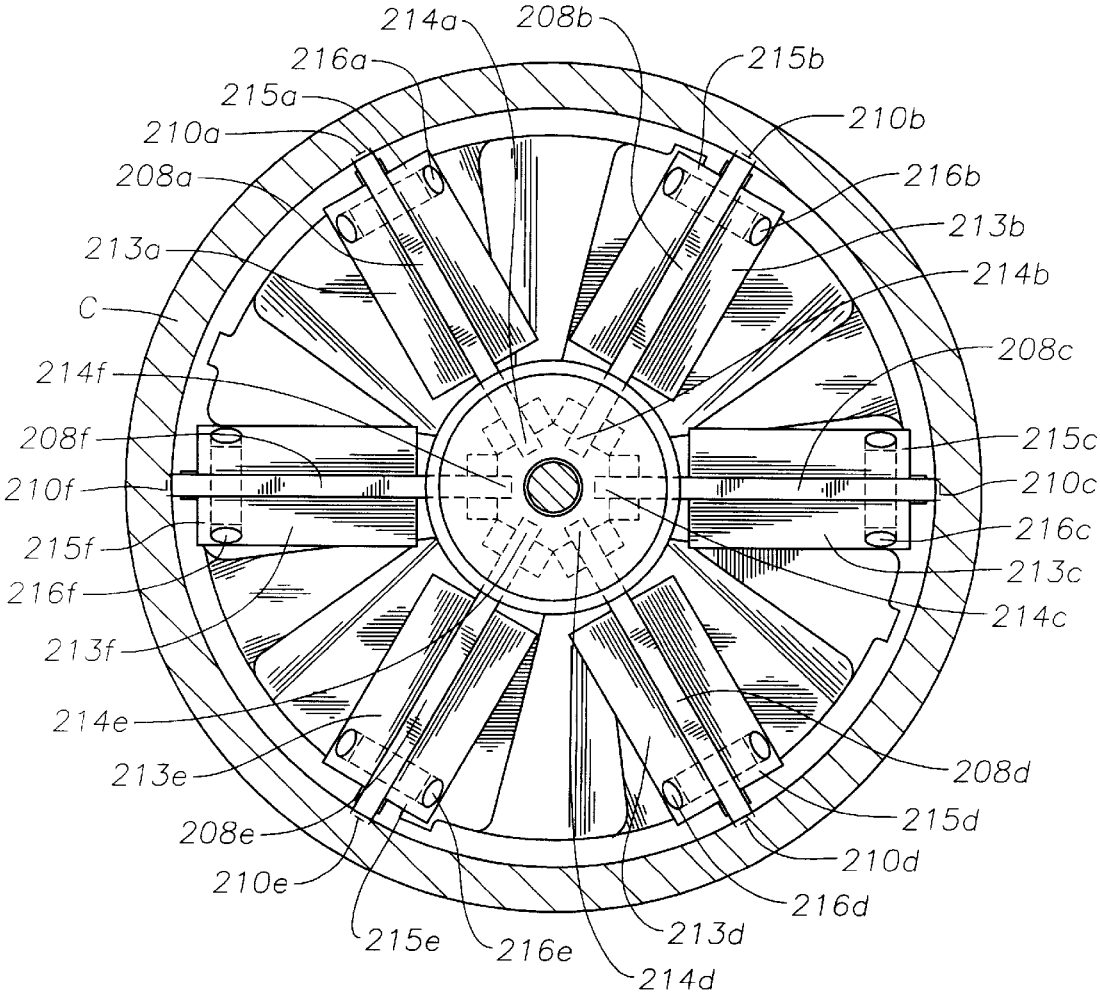
FIG. 7 is a planar view, looking upwardly, of the lower platform and resistor members in set condition.
Figure 5:
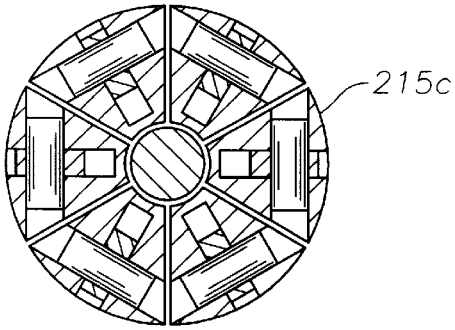
FIG. 5 is a cross-sectional view taken along line 5—5 of FIG. 1-B.
Figure 6:
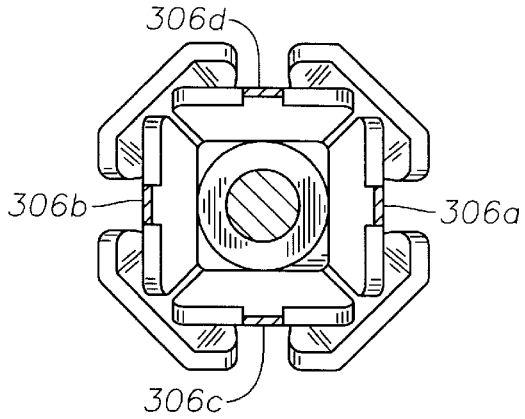
FIG. 6 is a cross-sectional view taken along line 6—6 of FIG. 1-B.

Now referring to FIG. 2-A, a second cylindrical housing member 207 is provided lowerly of the first cylindrical housing 206 with a bore 207*b* provided for receipt of the control mandrel section 204 therethrough. The second cylindrical housing member 207 has an outer diameter 207A (FIG. 1-F) which is the same as the outer diameter for the housing member 206. The series of struts 213*a*, 213*b*, 213*c*, 213*d*, 213*e* and 213*f* shown in FIG. 7 are provided and are carried by the second cylindrical housing member 207.

Each finger's respective second end 210 is secured to its mating strut by means of a pin 212 to permit movements there between. A plurality of the ends 210 of the fingers on the upper platform 201 are pointed, or sharpened, to provide a tip 210*a* which, when the device is moved to the set position shown in FIG. 2A causes the well tool 10 to be anchored in position relative to the well bore casing C, the tips 210 and 210*a* extending through a portion of the outer wall of the casing C.

Figure 2B:
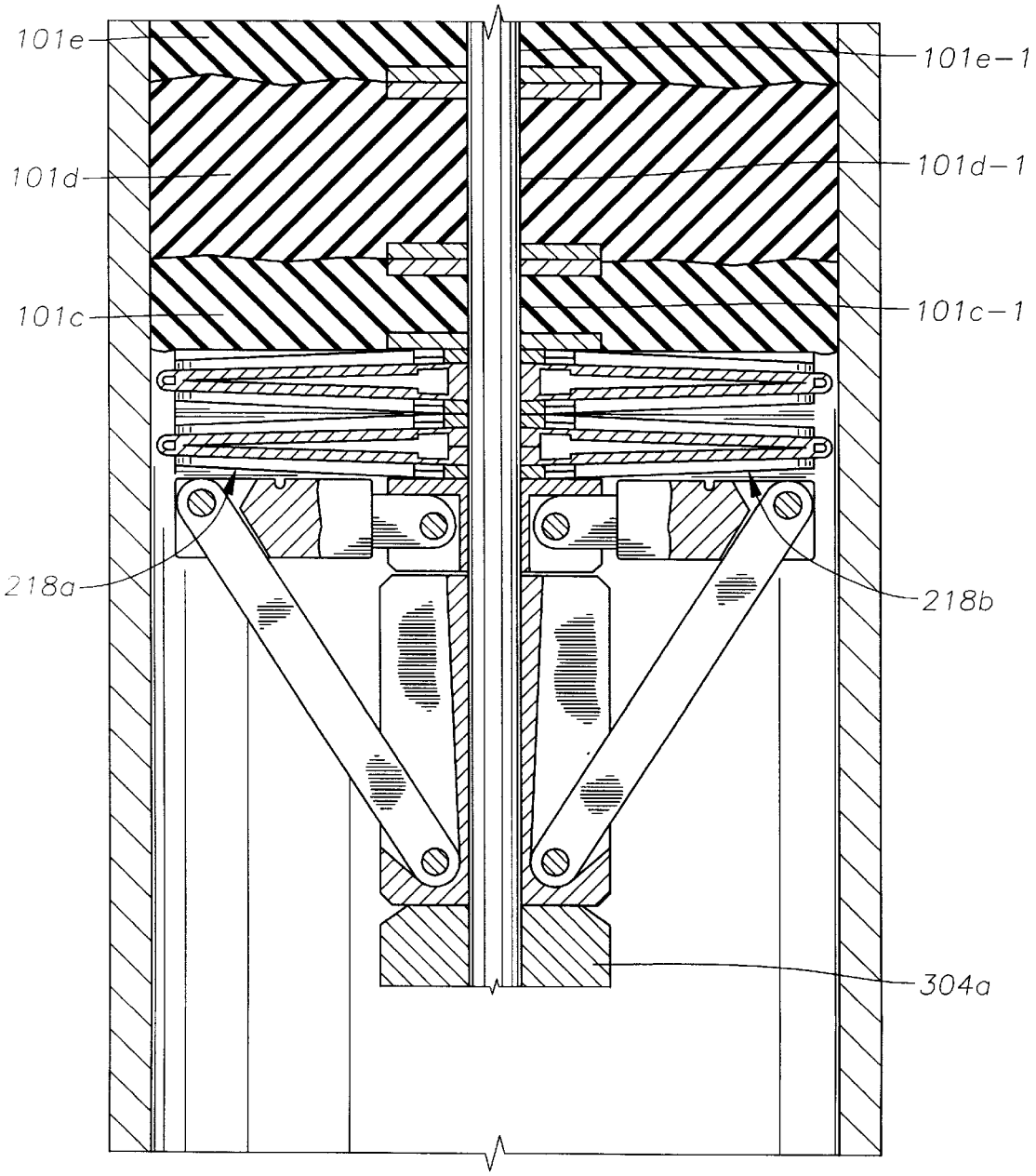
Figure 3:
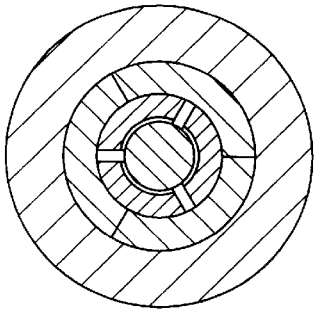
FIG. 3 is a cross-sectional view taken along line 3—3 of FIG. 1-A.
Figure 4:
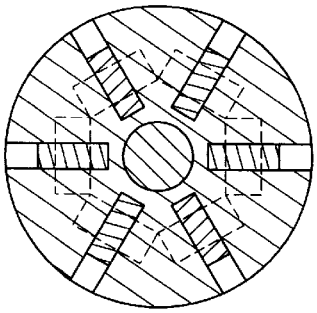
FIG. 4 is a cross-sectional view taken along line 4—4 of FIG. 1-A.

When in the collapsed or run-in position shown in FIGS. 1A through 1F, each of the struts together have an outer diameter 220' which is equal to that of the first and second housing members 207*a*, 206*a*. As shown in FIG. 2*b*, each of the struts has a platform base 218*a*, 218*b*, etc., which, when in the set position as illustrated in FIGS. 2A and 2B face toward the sealing rings such as 101*c*, 101*d*, and 101*e*.

The respective outboard ends 215*a*, 215*b*, 215*c*, 215*d*, 215*e*, and 215*f* of the struts 213*a*-f are connected to the respective second ends 210 of the fingers 208*a*-f by means of a hinge pin connection 216*a*, 216*b*, 216*c*, 216*d*, 216*e* and 216*f*, while the respective inboard ends 214*a*-f of the fingers 208*a*-f are pivotally secured to the first cylindrical housing member 206 by means of pin 211. The inboard end 214*a*-f of the struts 213*a*-f are secured by pivot pins, such as 217*a* and 217*b* illustrated in FIG. 1-B to the second cylindrical housing member 207.

The elastomer extrusion resistors will now be described. As particularly shown in FIGS. 1B, 1C, 1E and 8, the extrusion resistors are provided in series which includes first and second upper extrusion resistors 301*a* and 301*b* and first and second lower extrusion resistors 302*a* and 302*b*.

Each of the extrusion resistors is defined by means of a plate 302 having a series of radially extending separated first and second winged elements 305*a* and 305*b* secured one to another by flexible tabbed portions 306*a*, 306*b*, 306*c* and 306*d*. The plate 302 has upper and lower bores 303*a*, 303*b* through which the mandrel section 304 is disposed.

Figure 8:
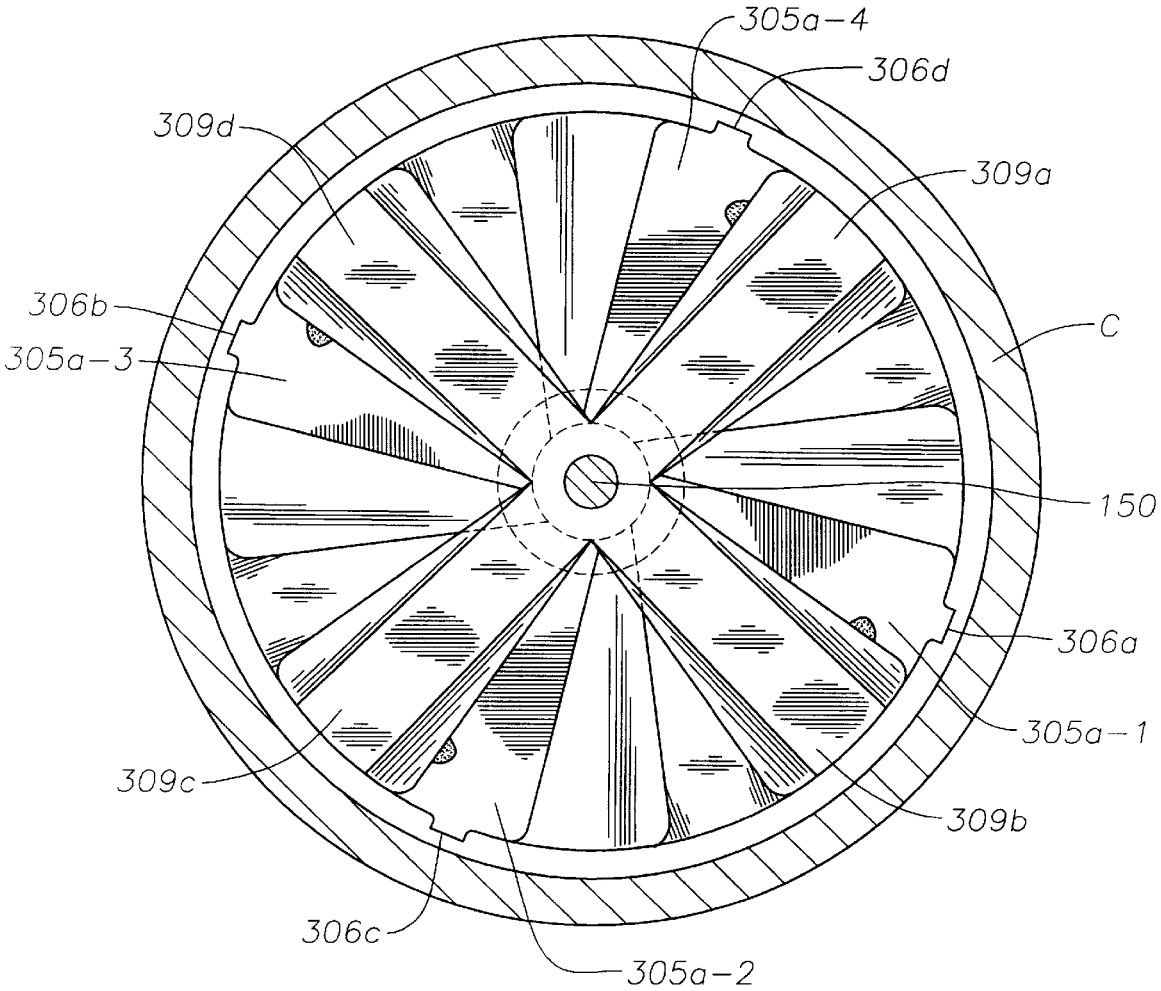
FIG. 8 is a view similar to that of FIG. 7, illustrating the components members of the extrusion resistors in the set or expanded position within the well.

Exteriorally around each of the plates 302 are upper and lower cup-like members 307*a* and 307*b* have outwardly extending fan-like blade members 309*a*, 309*b*, 309*c* and 309*d*. As shown in FIG. 8, for example, when moved to the expanded position in the well casing C, the blade members 309*a*–309*d* will be disposed in overlapping relationship with the respective wing members, such as those illustrated in FIG. 8 and identified as wing element members 305*a-1-4; to prevent extrusion of the elastomer.*

While only one cup element is shown around each end of a plate 302, it will be appreciated that a plurality of cup elements can be inserted at one or both of the ends of the plate 302 such that they provide complete radial overlapping with respect to each other, as well as the respective winged elements 305*a*-1 through 305*a*-4.

The extrudable elastomer member will now be detailed. As particularly illustrated in FIG. 9, the elastomer member consists of a number of rubber-like sealing rings such as 101*c*, 101*d*, 101*e* having companion bores 101*c*-1, 101*d*-1, 101*e*-1 for central receipt therethrough of a section 204 of the control mandrel. The sealing rings forming the elastomer member 101*c* may be made from a number of commercially available materials, such as ZEPTOL 1020 which is an elastomer system available from Nippon Chemicals, Inc. in Louisville, Ky., and their composition and manufacture do not form a particular part of the invention per se. Such sealing rings are known to compress and radially expand outwardly in conventional well casing C, as a result of application of a compressive load through the elastomer member 101.

In order to further assist truncation during setting and the transfer of compressive load through the elastomer 101 a series of metallic thrust disks 101*f*, 101*g*, 101*h*, and 101*i* may be positioned around the mandrel section 204 and in between two or more, or all, of the sealing rings. Additionally, a thrust disk 101*j* may be positioned between the uppermost seal member at the upper elastomer end 101*a* and the companion cup, such as 307*b*, or plate member, such as 302.

It will be appreciated that it is not essential to the practice of the present invention for such thrust rings to be incorporated into the elastomer member 101, but are preferably utilized in order to assist the initiation of truncation. A grease, oil or other known lubricant may be placed in between the various thrust rings, such as 101*f* and 101*g*, to facilitate rotational movements and, in fact, sliding of the disks themselves, during the setting procedure, and such movements are intended to be transferred to the adjoining thrust ring members.

As particularly shown in FIG. 1D, each of the sealing rings, such as 101*c*, 101*d*, will have incorporated therein truncation initiation means, such as a radially disposed inwardly protruding cut 101*d*-1 which extends toward the inner bore through each of the rings for receipt of the control mandrel member. The cuts, such as 101*d*-1, are provided for purposes of reducing torque load capacity through the sealing rings so that truncation may be initiated, resulting in the seals sealing against the inner wall of the casing C in a helixical configuration, to further enhance the efficient compactions of the elastomeric sealing rings and the sealing integrity of the elastomer member 101 and to reduce the propensity for stress relaxation as much as possible, and therein result in longer seal integrity.

The component parts of the set and release mechanism 700 will now be discussed and are shown in the initial position in FIG. 2A subsequent to release of a setting tool (not shown). The component parts of the release mechanism 700 are shown in their relative disengaged positions in FIG. 12 when a release tool RT is activated to release the well plug. The release mechanism 700 consists of an outer housing member 701 which includes a profile 702 interiorly defined there around for companion of receipt of locking dogs retained on the release tool RT. The inner most end of a series of sheer pins 704 extend within the bull portion 703 defined within a cone housing 705. The cone housing 705 has a "V"—shaped ramp 706 which has an enlarged interior diameter within its upper most end, as compared to a smaller internal diameter as the ramp 706 tapers downwardly. The cone housing 705 is made up of a number of radial sections (see FIG. 12) which, prior to release, are in side-by-side circular orientation, but break apart during the release operation. Within the cone housing 705 are a number of cones 712 which have an outer profile 713 which is tapered to conform with an complement the taper of the inner surfaces of the cone housing member 705. Such cone members 712 each have a series of interiorly facing ratchet threads 711, which, when the apparatus is in the set or manipulative position, ratchet in one-way direction with complimentary ratchet threads 220 on a control mandrel 207B, as shown in FIG. 2A. The cone member 712 as well as the cone housing members 705 are held together in relative position by means of the bias directed downwardly upon the upper ends of the cone members 712 by a spring 707 contained within a spring housing member 708 which, in turn, is selectively and initially secured to the cone housing members through threads 707A. The spring housing members 708 also has defined through its center an open bore 710 for receipt and movements of the control mandrel 207B. Finally, as shown in FIG. 2A, the control mandrel has a circumferentially extending outer cut to 220A (FIG. 1D) where the tinsel strength of the control mandrel is reduced relative to that through the mandrel at other points, such that upward pull upon the mandrel during the release in excess of the tinsel load strength of the rod at the cut will cause the mandrel 200 to part at the cut and the setting tool may be release from the plug.

Figure 12:
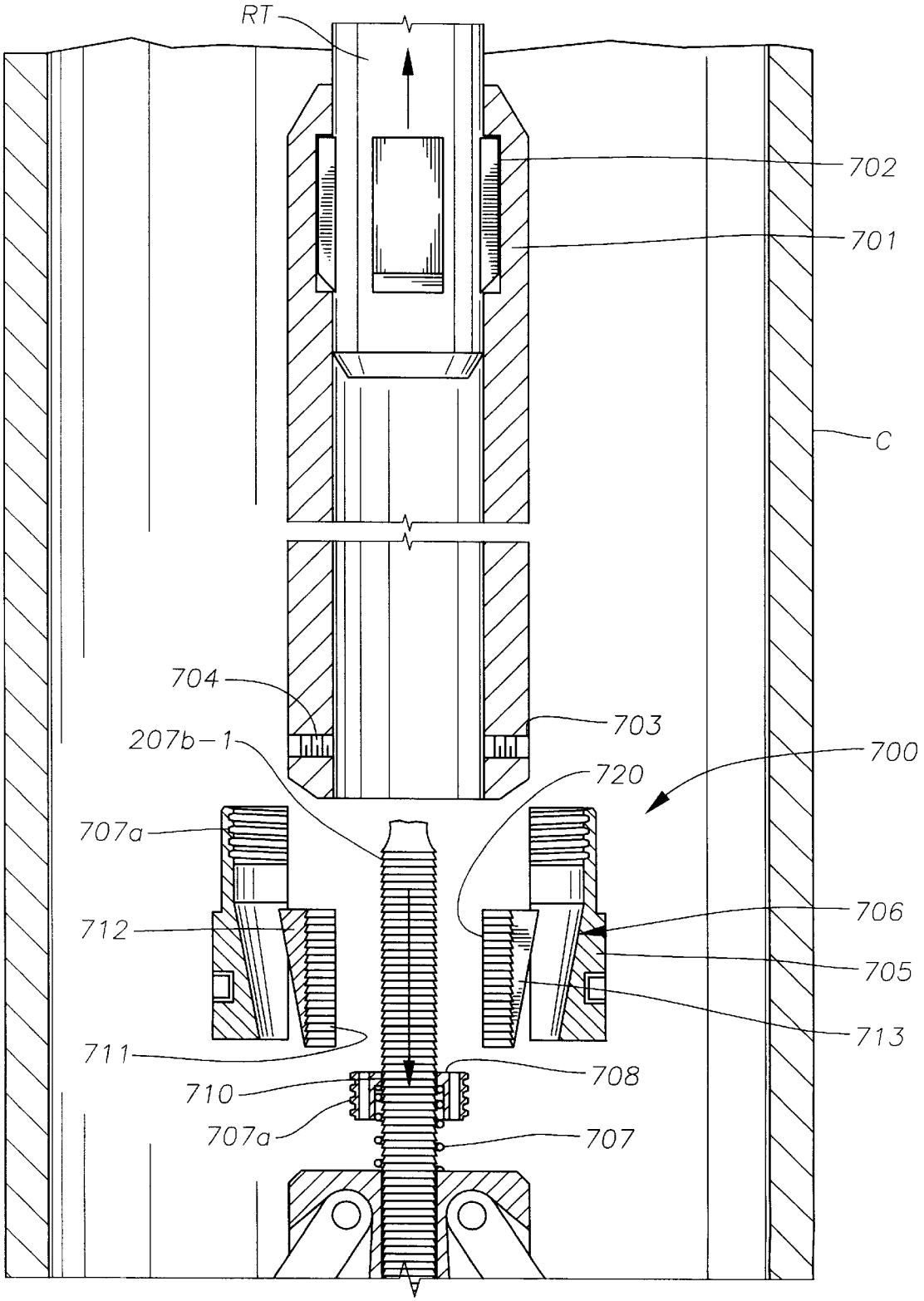
FIG. 12 is a schematic illustration of the locking and release assembly of the present invention with the component parts shown as in the released position.

When the plug is desired to be de-activated or retrieved, a pulling of retrieval tool (not shown) is run into the well to capture the outer housing 701 in a known fashion. The outer housing 701 is urged upwardly relative to the cone housing 705 and cones 712 therein and the sheer pin 704 is parted. The outer housing 701 is moved upwardly until such time as the lower end of same passes the approximate upper end of the spring housing 708. When this occurs, slide to compression between the cone housing 705 and the cone member 712 is discontinued and all such parts separate relative to one another, as illustrated in FIG. 12. The plug may now be retrieved to the top of the well.

The plug assembly of the present invention also provides means for storing the energy required to set the plug assembly. Such energy storage means is chargeable by the compressive stresses applied to the seal assembly during movement of the seal assembly to the set position. Such compressive stress energy is thereafter dischargeable into the seal assembly for retaining integrity of the seal assembly in the initial set position. Because the sealing elements contemplated for use in the present invention are elastomeric, they can be expected to experience unfavorable phenomena such as an elastic creep, and elastic stress relaxation, permanent setting and/or flow cutting. These phenomena cause the seal elements to loose their sealing function with the internal diameter of the casing because the housing of the plug is rigid. Once the utilized setting tool has been disengaged from the plug apparatus, the compressive hydrostatic stresses in the seal elements which activate the seal into sealing engagement with the inner wall of the casing begins to decay and diminish due to the occurrence of one or more of the above-identified phenomena. This decay occurs with time and the integrity and differential pressure rating of the seal assembly will diminish, if not so prevented. The energy storage means that the present invention provides a mechanism that maintains a reasonably constant magnitude of pressive hydrostatic stress in the seal elements because the energy storage means retains the bulk volume of the elastomer between the anti-extrusion device, the combination of the anti-extrusion system with the energy storage means permits the plug of the present invention to provide long term functional seals.

The stored energy system of the present invention is shown in the initial, or deactivated, position in FIG. 1F and contains a disk spring mandrel 801 which is secured at threads 802 to the lower end of the plug mandrel 204. The gods 304A provides an upper top for a series of disk springs 803 which receive the mandrel 801 through a central opening 804 through each of the springs. It will be appreciated that the spring 803 may be one, continuous, long compressed spring element, or, preferably as shown, a series of stacked disk elements 803. A bottom sub 804 is provided at the lower most end of the series of disk spring 803 and is secured by means of a locking spring 805 within a receiving bore 806 to the exterior of the lower most end of disk spring mandrel 801. Thus, when the plug apparatus is moved to the set position as shown in FIG. 2B, the plug mandrel 204 will carry the disk spring mandrel 801 upwardly and the compressive forces will be loaded into the sealing elements as well as into the energy storage means 800. As the mandrel 204 and the disk spring mandrel 801 move upwardly, this springs 803 are compressed as a result of the upward load transmitted through the mandrels 204 and 801 into the lower sub 804 and, thence, into the disk springs 803 to compress same. The energy thus stored may be utilized and continued to be applied against the set seal mechanism continuously after the setting operation in the well.

Now, with reference to FIGS. 10 and 11, a preferred seal assembly for incorporation into the plug is illustrated. The seal assembly 900 consists of an outer cylindrical shell 901 of a comparatively hard elastomer preferably having a Durometer rating of 85 or higher. Such elastomer is commercially available from Zeon Chemical Company and is marketed under the trademark Zetpol 1020, having an ultimate elongation of 600% and ultimate tensile strength of 3,000 psi.

The elastomeric core 902 is wrapped within the shell 901 by a web like material or sock 903 pending a series of radially disposed longitudinally extending unit directional bundles of fiberglass or graphite strands 904. These strands 904 are place in a web-like configuration having an expandable elastomeric body 905 such that the bundles of graphite strands 904 are permitted to snuggly engage the inner soft elastomeric core 902 but may expand and conform to the setting movements between the inner and outer elastomeric members 901 and 902 during the setting operation. The sock configuration 903 serves to abate extrusion of the soft elastomer 902 during setting of the plug in the well.

Figure 13:
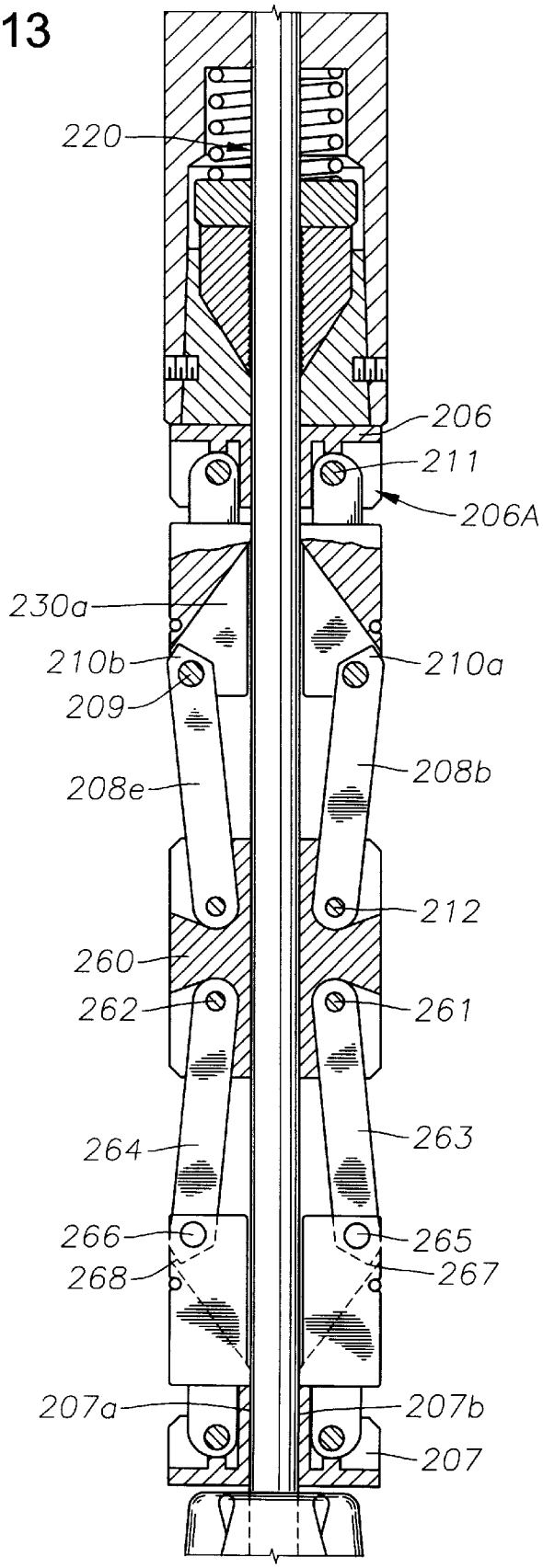
FIG. 13 is a view of an alternative embodiment incorporating upper, central and lower housing members incorporated as the upper platform system.
Figure 14:
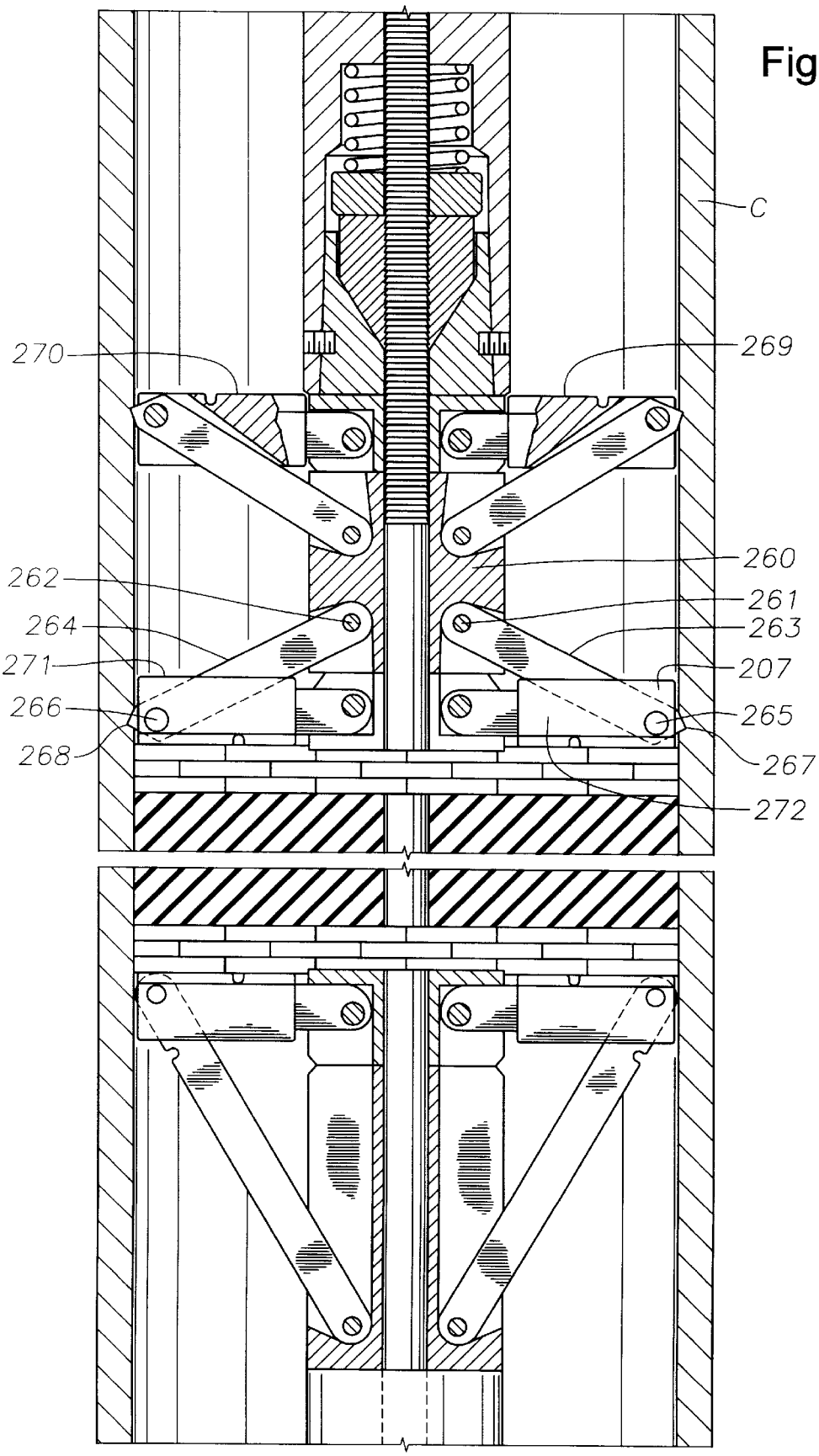
FIG. 14 is a view of the alternative platform configuration of FIG. 13 in set position in a well.

Now with reference to FIGS. 13 and 14 a variation in design is provided for the upper support platform member 206*a*, it being understood that such variation in design could easily be applicable to the lower most platform structure, or both. In the design of the platform member 206*a* shown in FIG. 13, a plurality of upper platform members 269 and 270 extend from the upper housing member 206, while similar but lower platform members 271 and 272 extend from the lower housing member 207. A middle or intermediate housing member 260 receives the lower ends of a series of finger elements, such as 208*b* and 208*e* shown in FIG. 13 and FIG. 14 which are secured thereto, such as by pin 212 to permit outer partial rotational movements to the set position shown in FIG. 14 from the run-in position shown in FIG. 13. Similar pins 261 and 262 in the central or middle housing member 260 likewise secure companion fingers, such as 263 and 264 to the housing member and pins 265 and 266 to secure the fingers to the lower most platform members 272 and 271. The fingers 263 and 264 each have outwardly projecting knife-like points 268 and 267 for grasping into the interior wall of the casing C as the device is set in the position shown in FIG. 14. Likewise, the upper finger members, 208*b* and 208*e*, and their companion radial finger members (not shown) have similar sharp outer edges 210*a* and 210*b* to perform the same function. When the upper platform support system is in engagement with the wall of the casing C as shown in FIG. 14, movements in opposing directions of the apparatus 10 is resisted.

OPERATION

It will be appreciated that the combination of the present invention may be run into the well and set using a number of commercially available setting mechanisms. All that is required is that a setting mechanism be utilized which will transmit sufficient "push" or "pull" force through the mandrel to transmit a high compressive load through the components forming the invention, resulting in the expansion of the sealing rings with as little extrusion of the elastomer component as possible. Preferably, a setting tool commercially available from High Pressure Integrity, Inc., of New Orleans, La. may be utilized. Such device is disclosed in my co-pending application Ser. No. 09,389,698, filed May 11, 1999, and entitled "Electrically Actuated Setting Tool".

When the device is run into the well and located at the desired position, compressive load through the control mandrel 304 is initiated, continuously and slowly. Assuming that the tool 10 is to be utilized with a mandrel manipulated by a setting tool which causes compressive load to be transmitted as the mandrel is pulled upwardly, the tool 10 will have the configuration as shown in the drawings. Grasping and anchoring relative to the casing C is effected by means of the pointed tips 210*a*, etc. As the mandrel 304 is pulled upwardly by the setting tool (not shown) the mandrel sub 304*a* (FIG. 1F) will urge the first or lower, cylindrical housing member 206 upwardly such that each of the fingers 208*a*/208*f* move outwardly and the struts 213*a*/213*f* move into horizontally aligned expanded setting position, and the pointed tips 210*a*/210*f* are driven into the wall of the casing C.

As the struts 213*a*/213*f* move into setting position, as described, the top end of the cylindrical housing member 206 will contact the lower end of the second housing member 207, and each platform face 218*a*/218*f* will contact the lowermost end of a plate member 302.

Continued compressive load applied through the mandrel 304 and transmitted through the plate 302 will cause the failure of the securing tabs 306*a*/306*b*, permitting the first and second wing elements 305*a*/305*b* to flex and move toward one another, carrying in companion flexing movements the various flexible cup members, such that the blades move outwardly around the respective wing element of the plate 302 to the general position shown in FIG. 7.

It will be appreciated that once the pointed tips 210 are anchored into the casing C, the upper and lower articulating anti-extrusion platforms and the extrusion resistors will continue activation, substantially simultaneously, such that after crushing of the plates 302 and the opening of the companion cups, such as 307*a*, the compressive load is transmitted through the thrust rings, such as 101*e*, 101*f*, 101*g*, and, thence, into the respective sealing ring, such as 101*c*/101*e*.

Figure 9:
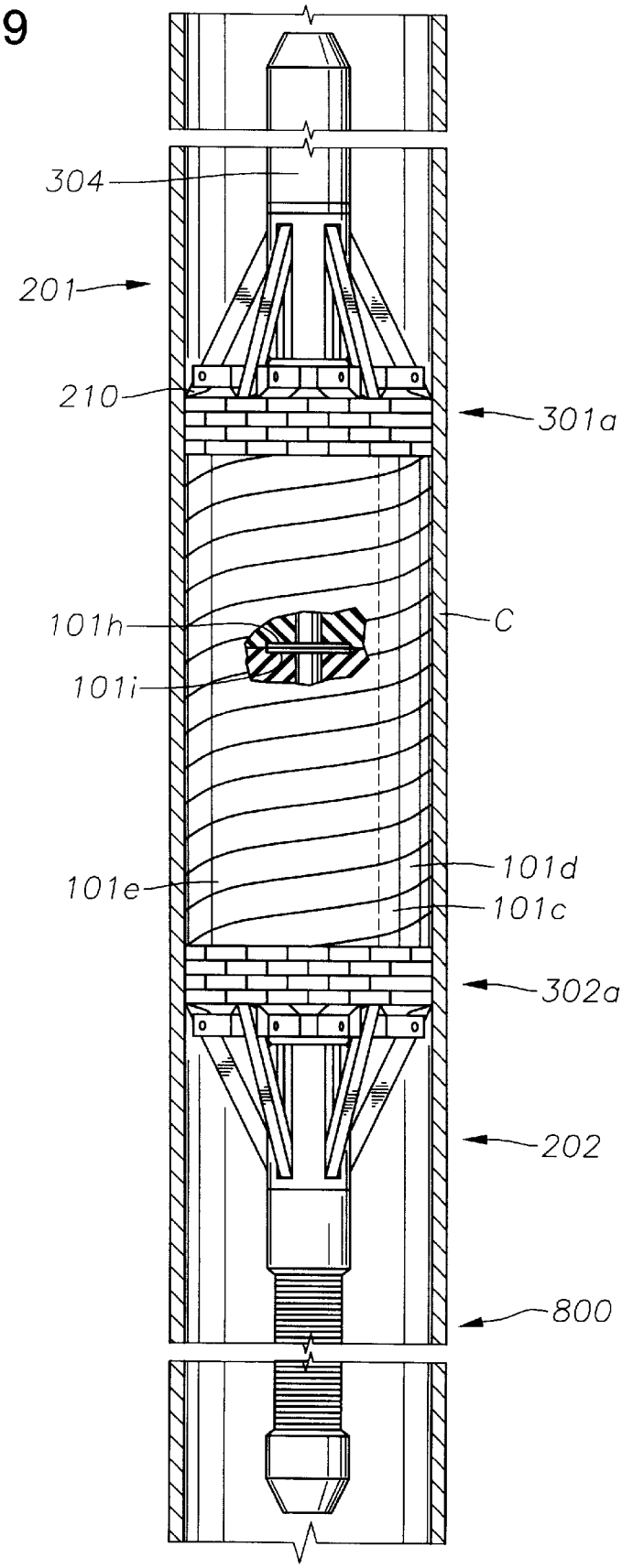
FIG. 9 is a schematic illustration of the apparatus of the present invention in the set position within the well bore casing, with particular illustration of the spiral configuration of the seal members after truncation.

Continued slow upward pull upon the control mandrel will approach the compressive load limits of the design and components of the elastomers in the sealing rings with the load being restricted as a result of the cut 101*d*-1 in each of the seal rings such as 101*c*/101*e*. Further slow pull upon the control mandrel will cause slight rotational movement through the various thrust rings and into the seal ring bodies. Now, the compressive load is transposed into a slight outward spiraling of the elastomer members such that contact with the inner wall of the casing C of such seal elements 101*c*/101*e* in combination with continued upward pull on the control mandrel 304 will cause the helixical configuration during final setting as shown in FIG. 9.

During setting, it will be appreciated that the elastomer member will have a tendency to extrude. However, such extrusion is dramatically abated by use of the extrusion resistors of the present invention which are supported by the anti-extrusion platforms, thus assuring sealing integrity of the elastomer components.

The compressive load may be locked into the tool 10 through the mandrel 304, in known manner, either through the setting tool, or otherwise. As shown in FIG. 2-A, the setting load is locked into the tool through the interengagement of the mandrel and the release mechanism 700 at threads 720 on the interior of wedge member 712 and threads 207B-1 on the mandrel portion 207-*b*.

When it is desired to release the tool 10 from the setting position shown in FIG. 2-A for removal to the top of the well, or placement at another location within the well, a retrieving tool (not shown) may be run into the well and locking dogs may be placed within the retrieving profile 702 of the housing 701 of the retrieving mechanism 700. As pull is applied through the retrieving tool 701, the pens 704 will be sheared, permitting the housing 701 to move upwardly. Now, the series of conical members 705 will break apart, concurrently freeing the interengagement of the threads 720 and 207*b*-1 from interengagement as the inner wedge members 712 are displaced relative to the mandrel member 207*b* such that the components of the release mechanism 700 become disengaged from one another as shown in FIG. 12. The tool 10 may be either pushed to the bottom of the well or retrieved to the top of the well for reconditioning and re-use.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A subterranean well tool, comprising:

(a) a control mandrel including one way ratcheting teeth exteriorally defined thereon;

(b) an elastomeric sealing assembly having first and second ends and outwardly expandable to an initial set position within said well by compressive hydrostatic stress applied through said mandrel substantially simultaneously to each end of said assembly;

(c) crushable means positioned at each end of the seal assembly and forming a plurality of radially extending overlapping wing elements for abating extrusion of the elastomer of said sealing rings;

(d) an articulating support platform outboard of each of said crushable means, each said platform including first and second housing members moveable toward one another upon application of the compressive hydrostatic stress through said tool to shift said support platforms into crushing engagement with said crushable means; and (e) selectively releasable locking means disposed around said mandrel for selectively locking and releasing the compressive force into the seal assembly, said locking means including an outer locking housing; a series of first conically tapered outer retainers initially retained within said housing but selectively releasable therefrom; a series of second conically tapered inner retainers disposed interiorly therearound and within said first conically tapered outer retainers, said second conically tapered inner retainers including one way ratchet teeth for ratcheting engagements with the mandrel ratcheting teeth to prevent relative movements between said locking means and said mandrel in one direction; and biasing means contained within said outer retainers for urging said outer and inner retainers into a lockable position relative to said mandrel.

2. The well tool of claim 1 further including means for releasing the locking means and unlocking the compressive force in the seal assembly.

3. In combination with a subterranean well tool manipulatable between a run-in condition and a set position in a well bore casing and including a well plug member having an expandable elastomer member for sealing across an interior area in said well bore casing, said extruding elastomer member having first and second ends, an articulating anti-extrusion support system for said well plug member, comprising:

(1) upper and lower articulating anti-extrusion platforms, each of said platforms comprising:

(a) a control mandrel including sections for transmitting a compressive load through said system and to said elastomer;

(b) first and second vertically aligned cylindrical housing members of equal outer diameter;

(c) a bore defined through each of said cylindrical housing members for receipt of the control mandrel section;

(d) a series of elongated normally retracted outwardly pivotal supporting finger elements movable between retracted and extended positions, said supporting finger elements being radially disposed around the exterior of one of said cylindrical housing members, each of said supporting finger elements having first and second ends, said first end of each supporting finger being joined relative to the said one cylindrical housing to permit pivotal movements of said supporting fingers between said retracted and extended positions, each of said supporting fingers having an outer diameter;

(e) means for anchoring the combination to said casing to resist movement of one of the platforms in one direction as said mandrel is manipulated to move said combination to said set position;

(f) a series of normally collapsed platform struts radially disposed around and outwardly extendable relative to the other of said cylindrical housings, all of said platform struts defining one outer diameter around the housing members, when the tool is in the run-in position, each of said platform struts having inboard and outboard ends relative to the other of said cylindrical housings, the inboard end of each of said platform struts being pivotally secured relative to said other of the cylindrical housings to selectively permit said platform struts to expand radially outwardly, each of said platform struts being joined at the outboard end in hinged relationship to one of the supporting finger elements, each of said platform struts having a face portion; said housing members, said fingers and said struts being juxtapositioned relative to one another when said combination is in said run-in position, whereby said platform struts are in collapsed condition and said fingers are in a retracted position, and further whereby when in said run-in position the outer diameter of said fingers and said struts is no greater than the outer diameter of said housing members, and upon manipulation of said mandrel to activate said well tool, said first housing member is moved toward the second housing member and said fingers and said struts are articulated into the set position; and (2) a series of elastomer extrusion resistors positioned at each of the ends of the elastomer member, each resistor comprising:

(a) a plate positioned between a platform and one end of the extruding elastomer and crushable upon manipulation of said mandrel from said run-in condition to said set position;

(b) upper and lower bores defined through said crushable plate for receipt therethrough of the mandrel section;

(c) a series of first and second selectively radially outwardly flexible wing elements defined by said plate and extending around said upper and lower bores of said plate, respectively;

(d) means for flexibly securing each of said first and second wing elements to another of said first and second wing elements;

(e) a flexible cup member placed over each end of the plate, each of said flexible cup members having a passageway aligned with the bore of the plate and receiving the mandrel section therethrough, each flexible cup member providing a series of radially expandable blade members for overlapping interalignment between a plurality of said wing elements when said well tool is moved to the set position; said face portion of each of said platform struts contacting and supporting at least one of the wing and blade elements during crushing of the plate and expansion of the elastomer member by the compressive load transmitted by the well tool; said wing and blade elements substantially intermeshing with said elastomer member at each end thereof to resist extrusion of said elastomer member when said well tool is moved to the set position; said extruding elastomer member comprising:

(1) a series of spirable elastomeric sealing rings stacked around said mandrel and compressible in an outwardly expanding helixical configuration upon application of the compressive load transmitted by said mandrel through said support system;

(2) truncation initiation means on each of said sealing rings; and (3) flexible thrust transmitting means rotatably secured around the mandrel and disposed between each of the sealing rings, said rings and said thrust transmitting means transposing the compressive load generated through said mandrel into torque to activate the truncation initiation means and spiral said rings into the set position;

a bore being defined through each of the elastomeric sealing rings for receipt of said mandrel, said bore having a center line disposed therethrough, and said truncation initiation means includes a radially extending cut through each of said sealing rings and offset radially around said rings about 90° relative to the center line of said rings, said cut, upon application of torque through said sealing rings, inducing outward helical flexing movements by said rings.

4. The well tool of claim 3 further comprising an energy storage means chargeable by the compressive force applied to the sealing rings during movement of said rings to the set position and thereafter being dischargeable to transmit the compressive force within the storage means into the sealing rings for retaining integrity of said sealing rings in the set position.

5. The well tool of claim 4 further comprising means for applying the compressive force to said sealing rings to move said sealing rings to said set position, and further comprising a control mandrel manipulatable by said means for applying the compressive force to the sealing rings and spring means moveable from a first expanded position to a second contracted position by said mandrel.

6. The well tool of claim 5 wherein the spring means includes a series of stacked flexible disks.

7. The well tool of claim 6 wherein the spring means includes a series of stacked flexible disks and said mandrel is introduced through the center of each of said flexible disks.

8. A subterranean well tool, comprising:

(a) an elastomeric seal assembly having first and second ends and outwardly expandable to a set position by compressive hydrostatic stress applied substantially simultaneously through each end of said assembly;

(b) means for applying the compressive hydrostatic stress to said seal assembly to move said seal assembly to said set position; and (c) energy storage means chargeable by the compressive stress applied to the seal assembly during movement to the set position and thereafter being dischargeable to transmit said stored compressive stress into the seal assembly for retaining integrity of said seal assembly in the initial set position.

9. The well tool of claim 8 wherein the energy storage means comprises a control mandrel manipulatable by said means for applying the compressive hydrostatic stress to the seal assembly and spring means moveable from a first expanded position to second contracted position by said mandrel.

10. The well tool of claim 9 wherein the spring means includes a series of stacked flexible disks.

11. The well tool of claim 9 wherein the spring means includes a series of stacked flexible disks, and said mandrel is disposed through said series of disks.

12. The well tool of claim 8 wherein the means for applying the compressive hydrostatic stress to said seal assembly includes a crushable means positioned at each end of said assembly and forming a plurality of radially extending overlapping wing elements.

13. The subterranean well tool of claim 8 wherein the means for applying the compressive hydrostatic stress to the seal assembly comprises a crushable means positioned at each end of said seal assembly and forming a plurality of radially extending overlapping wing elements and an articulating support platform outboard of each of said crushable means, each said platform including first and second housing members movable toward one another upon application of said compressive hydrostatic stress through said well tool to shift said support platforms into crushing engagement with said crushable means.

14. The well tool of claim 13 wherein one of said platforms includes means for anchoring said platform in said subterranean well against movements in one direction.

15. A subterranean well tool, comprising:

(a) a series of stacked elastomeric sealing rings outwardly expandable to set position by a compressive force applied substantially simultaneously at each end of the series, each of said rings comprising an elastomeric cylindrical shell having a first Durometer hardness, an inner elastomeric core having a second Durometer hardness less than the Durometer hardness of said shell, and a radially flexible sock disposed interiorly of said shell and around said core;

(b) crushable means positioned at each end of the series of rings forming a plurality of radially extending overlapping wing elements for abating extrusion of the elastomer of said sealing rings;

(c) an articulating support platform outboard of each of said crushable means, each said platform including first and second housing members moveable toward one another upon application of the compressive force through said tool to shift said support platforms into crushing engagement with said crushable means; and (d) truncation initiation means on each of the said sealing rings; a mandrel for delivering a compressive load to said truncation initiation means and said sealing means; and flexible thrust transmitting means rotatably secured around the mandrel and disposed between each of the sealing rings, said rings and said thrust transmitting means transposing the compressive load generated through said mandrel into torque to activate the truncation initiation means and to spiral said rings into a set position;

a bore being defined through each of the sealing rings for receipt of said mandrel, said bore having a center line disposed there through, and said truncation initiation means includes a radially extending cut through each of said sealing rings off-set radially around said rings about 90 degrees relative to the center line of said rings, said cut, upon application of torque through said sealing rings, inducing outward helical flexing movements of said rings.

* * * * *